US007006651B2

(12) United States Patent
Ueki

(10) Patent No.: US 7,006,651 B2
(45) Date of Patent: Feb. 28, 2006

(54) SPEAKER

(75) Inventor: Masataka Ueki, Joetsu (JP)

(73) Assignee: Uetax Corporation, Niigata (JP)

( * ) Notice: Subject to any disclaimer, the term of this patent is extended or adjusted under 35 U.S.C. 154(b) by 226 days.

(21) Appl. No.: 10/275,713

(22) PCT Filed: Feb. 25, 2002

(86) PCT No.: PCT/JP02/01658

§ 371 (c)(1),
(2), (4) Date: Nov. 8, 2002

(87) PCT Pub. No.: WO02/069669

PCT Pub. Date: Sep. 6, 2002

(65) Prior Publication Data

US 2003/0123692 A1 Jul. 3, 2003

(30) Foreign Application Priority Data

Feb. 26, 2001 (JP) ..... 2001-050445

(51) Int. Cl.
*H04R 25/00* (2006.01)

(52) U.S. Cl. ..... 381/396; 381/401; 381/412; 381/398; 381/404

(58) Field of Classification Search ..... 381/334, 381/396, 400, 412, 398, 392, 189, 404, 386, 381/395, 401; 367/174, 175, 141; 181/172, 181/171, 163
See application file for complete search history.

(56) References Cited

U.S. PATENT DOCUMENTS 5,825,718 A 10/1998 Ueki et al.

FOREIGN PATENT DOCUMENTS

| | | |
|---|---|---|
| JP | 54-159108 | 12/1979 |
| JP | U-55-124994 | 9/1980 |
| JP | 60-64599 | 4/1985 |
| JP | 60-112158 | 7/1985 |
| JP | 60-160233 | 8/1985 |
| JP | 6-311597 | 11/1994 |
| JP | 10-93672 | 4/1998 |

(Continued)

OTHER PUBLICATIONS

Patent Abstracts of Japan, vol. 009, No. 201, Aug. 17, 1985 & JP 60 064599 A (PIONEER KK), Apr. 13, 1985.

(Continued)

*Primary Examiner*—Huyen Le
*Assistant Examiner*—Tuan Duc Nguyen
(74) *Attorney, Agent, or Firm*—Nixon & Vanderhye, P.C.

(57) ABSTRACT

A small and high-performance waterproof speaker which can be manufactured inexpensively by decreasing the number of components. Front face of a case (1) is sealed hermetically by a water resistant diaphragm (2) from which a voice coil (3) is projecting inward and a magnetic circuit part (5) having a part (6*a*) being fitted to the voice coil (3) and a permanent magnet (8) is secured to a first resilient plate (4) provided in the case (1). The first resilient plate (4) is provided with a plurality of through holes (18) and the fitting part (6*a*) is coupled with the diaphragm (2) through a first coupling member (13) of resilient material. On the other hand, an inertial member (12) is secured to a second resilient plate (11) disposed, oppositely to the first resilient plate (4), in the case (1) and the second resilient plate (11) is coupled with the first resilient plate (4) through a second coupling member (14) of resilient material.

21 Claims, 8 Drawing Sheets

FOREIGN PATENT DOCUMENTS

| | | |
|---|---|---|
| JP | 11-113082 | 4/1999 |
| WO | 00/02303 | 1/2000 |

OTHER PUBLICATIONS

Patent Abstracts of Japan, vol. 1999, No. 09, Jul. 30, 1999 & JP 11 113082 A (UETAKKUSU KK), Apr. 23, 1999.

European Search Report mailed Mar. 22, 2005 in corresponding EP application No. 02700744.2-2202-JP201658.

Microfilm of the specification and drawings annexed to the request of Japanese Utility Model Application No. 23686/1979 (Laid-open No. 124994/1980), Sep. 4, 1980.

Microfilm of the specification and drawings annexed to the request of Japanese Utility Model Application No. 203576/1983 (Laid-open No. 112158/1985), Jul. 30, 1985.

SPEAKER

This application is the US national phase of international application PCT/JP02/01658 filed 25 Feb. 2002 which designated the U.S.

TECHNICAL FIELD

The present invention relates to a speaker suitable for portable communication equipment of, for example, a portable telephone and the like or underwater use portable communication equipment of an underwater headphone and the like.

BACKGROUND ART

Conventionally, as a speaker for use in water, there has been, for example, the one described in Japanese Patent No. 3057039 (Japanese Patent Laid-Open Publication No. HEI 11-113082). This speaker, which is to be used by a diver in water, has a cylindrical watertight casing whose fore end surface serves as a diaphragm, a voice coil provided projectingly at the center of the inner surface of this diaphragm, a columnar portion put oppositely in this voice coil and a magnetic circuit section that is provided with a permanent magnet and fixed on an elastic support plate, the elastic support plate peripherally fixed on a front chamber wall of the watertight casing, a control board that is provided with a control section, a digital signal generator section, a changeover section, a D-to-A converter, a power amplifier and so on and is fixed to the lower surface of the magnetic circuit section, and a battery and a switch housed in a rear chamber of the watertight casing partitioned by a partition plate provided with through holes.

If the switch is turned on to make a selection with the changeover section, then a combination signal of the corresponding specific frequencies is inputted from the digital signal generator section to the D-to-A converter, and an analog signal obtained through the conversion is amplified and thereafter inputted to the speaker, consequently producing a sound like "peep-poh peep-poh" or "pah-peep pah-peep" expressing specific information in water.

With regard to the above-mentioned speaker, the diaphragm provided with the projecting voice coil is elastically deformed by a water pressure so as to be pressed inward in accordance with an increase in water depth, and the pressure inside the front chamber, which is partitioned by this diaphragm and the elastic support plate, increases. However, the elastic support plate is also elastically deformed so as to be pressed toward the rear chamber side. Consequently, the magnetic circuit section on the elastic plate is also pressed inward, and the engagement between the voice coil and the magnetic circuit section required for the normal driving of the diaphragm is maintained. That is, the speaker can produce a satisfactory sound even when it receives a water pressure at a water depth of not smaller than 10 m.

However, the aforementioned conventional speaker for diver use has a disadvantage that it is comparatively large and, if downsized, air in the casing generates a distortion due to the vibrations of the diaphragm.

Moreover, there is a disadvantage that, when the elastic support plate that is supporting the magnetic circuit section is reduced in thickness in accordance with the downsizing, the air in the casing repeats compression and expansion when the diaphragm produces a low-pitched sound of a great sound pressure, and the voice coil of the diaphragm becomes unable to smoothly move with respect to the magnetic circuit section, causing unstable operation of the diaphragm.

DISCLOSURE OF THE INVENTION

Accordingly, the object of the present invention is to provide a downsized high-performance waterproof speaker, which is able to generate vibrations and a sound for warning use in addition to the original functions of the speaker and is able to be manufactured at low cost with a reduced amount of components.

In order to achieve the above object, there is provided a speaker having a diaphragm provided so as to seal inside of a casing on a front surface of the casing, a voice coil provided projectingly on the diaphragm toward the inside of the casing, a first elastic plate, which is made of an elastic material and provided for the casing so as to oppose to the diaphragm, and a magnetic circuit section, which has an engagement portion to be put in the voice coil and a magnet and is fixed to the first elastic plate, wherein the elastic plate is provided with a through hole for communication between a front chamber located on the diaphragm side and a rear chamber located oppositely to the diaphragm inside the casing partitioned by the first elastic plate, and a sound is produced by vibrations of the first elastic plate accompanied by mutual communications of air in the front chamber and the rear chamber via the through hole or resonance of the air in the front chamber and the rear chamber.

In the speaker of the claim 1, the diaphragm, where a signal current flows through the voice coil provided projectingly, and the magnetic circuit section, which has an engagement portion that is put in the voice coil and connected to the diaphragm and the magnet and is fixed on the first elastic plate in the casing, perform relative motion. When the produced sound has a low frequency, the air in the front chamber and the rear chamber, partitioned by the first elastic plate, communicate with each other via the through hole, and the first elastic plate vibrates in accordance with this. When the produced sound has a high frequency, there is scarce communication of air via the through hole, and the air in the front chamber and the rear chamber resonate at a specific frequency corresponding to the volume. This speaker is able to be easily manufactured at low cost since it has a small amount of members and downsized with a satisfactory sound maintained since the internal air is not distorted during sound production in spite of the compactness thereof.

As described above, a sound is produced mainly by the vibrations of the first elastic plate in the low frequency region and mainly by the resonance of the air in the front and rear chambers in the high frequency region. Therefore, even if the speaker is downsized so as to be applied to portable communication equipment, there can be produced not only a satisfactory high-pitched sound but also a satisfactory low-pitched sound. Moreover, the constituent members of the speaker are all housed in the casing sealed with the diaphragm, and therefore, the speaker can be used without any problems even in a bad environment of air that includes dust or the like.

In one embodiment of the present invention, the speaker comprises:

a first connecting member that is made of an elastic material and connects the engagement portion of the magnetic circuit section with the diaphragm;

a second elastic plate that is made of an elastic material and is provided for the casing so as to oppose to the first elastic plate;

an inertial member fixed on the second elastic plate; and a second connecting member that is made of an elastic material and connects the second elastic plate with the first elastic plate.

In the above-mentioned speaker, the diaphragm, where a signal current flows through the voice coil provided projectingly, and the magnetic circuit section, which has an engagement portion that is put in the voice coil and connected to the diaphragm by the first connecting member and the magnet and is fixed on the first elastic plate provided inside the casing, perform relative motion to produce a sound. When the produced sound has a low frequency, the air in the front chamber located on the diaphragm side with respect to the first elastic plate and the air in the rear chamber located on the second elastic plate side with respect to the first elastic plate communicate with each other via the through hole provided through the first elastic plate. Consequently, the diaphragm, the first elastic plate on which the magnetic circuit section is fixed and the second elastic plate which is connected to the first elastic plate via the second connecting member and on which the inertial member is fixed mainly resonate. When the produced sound has an intermediate or high frequency, there is scarce communication of air via the through hole, and the second elastic plate on which the inertial member is fixed scarcely vibrates. Consequently, the diaphragm and the air in the front chamber and the rear chamber mainly resonate. Moreover, this speaker can easily be downsized since the internal air is not distorted during sound production in spite of the compactness of the casing.

As described above, sounds are produced mainly by resonance in both the low frequency region and the intermediate and high frequency region. Therefore, if the speaker is downsized so as to be applied to portable communication equipment, there can be obtained not only a satisfactory intermediate- and high-pitched sound but also a satisfactory low-pitched sound. Moreover, the constituent members of the speaker are all housed in the casing sealed with the diaphragm, and therefore, the speaker can be used without any problems even in a bad environment of air that includes dust or the like.

In one embodiment of the present invention, the casing has a bottom portion opposite to the second elastic plate, defining a back surface chamber between the second elastic plate and the casing.

In the above-mentioned speaker, the back surface chamber is formed between the second elastic plate and the bottom portion of the casing, and therefore, a space between the second elastic plate and the first elastic plate corresponds to the rear chamber, and a space between the first elastic plate and the diaphragm corresponds to the front chamber. Therefore, the constituent members of this speaker and the air in the front and rear chambers also operate similarly to the description of the aforementioned embodiment. Therefore, even if the speaker is downsized so as to be applied to portable communication equipment, there can be produced satisfactory low-pitched sound and intermediate- and high-pitched sound. Moreover, the constituent members of the speaker are all housed in the casing sealed with the diaphragm and the bottom portion of the casing, and therefore, the speaker can be used without any problems even in a bad environment of air that includes dust or the like. This speaker can reduce amount of components and be downsized more, since it has no back surface chamber.

In one embodiment of the present invention, one surface of the second elastic plate is exposed to outside.

In the above-mentioned speaker, the second elastic plate covers the bottom portion of the casing and seals the inside of the casing, and therefore, the space between the second elastic plate and the first elastic plate corresponds to the rear chamber, and the space between the first elastic plate and the diaphragm corresponds to the front chamber similarly to the description of the aforementioned embodiment. Therefore, the constituent members of this speaker and the air in the front and rear chambers also operate similarly to the description of the present invention. Therefore, even if the speaker is downsized so as to be applied to portable communication equipment, there can be produced satisfactory low-pitched sound and intermediate- and high-pitched sound, and the speaker can be used without any problems in a bad environment of air that includes dust or the like. Moreover, since this speaker has no back surface chamber, a reduction in the amount of members and further downsizing can be achieved by that much.

In one embodiment of the present invention, the first elastic plate is a disk such that the magnetic circuit section is fixed to a center hole and its periphery is fixed to an inner wall of the casing, and the through hole is provided with an identical shape in areas obtained by dividing the disk equally into a prescribed number of sectors and comprised of a first arc-shaped groove that is opened at one end of an outer periphery of the sector and approaches the center hole while extending in a circumferential direction to the other end of the sector and a second arc-shaped groove that is opened at the other end of the outer periphery of the sector and approaches the center hole while extending in the circumferential direction to the other end of a sector whose one end abuts against the other end of the sector.

As is apparent from the concrete example in which the disk shown in FIG. 7 is divided equally into three sectors, the elastic plate of the speaker has sufficient elasticity for alleviating impact by virtue of the first and second arc-shaped grooves, the magnetic circuit section is fixed to the center hole of the disk, and the three outermost peripheral portions of the disk are fixed to the inner peripheral wall of the casing. Therefore, the first elastic plate smoothly vibrates while producing a buffering effect particularly when the air in the front chamber and the air in the rear chamber communicate with each other via the arc-shaped grooves of the first elastic plate. The vibrations are transmitted to the plate member that seals the end of the rear chamber, and a satisfactory sound at a low frequency is produced. Moreover, by virtue of the buffering effect of the first elastic plate, the magnetic circuit section moderately vibrates in the low frequency region even if the air volume is reduced by downsizing, and a satisfactory sound can be produced.

In one embodiment of the present invention, the engagement portion of the magnetic circuit section has a through hole for communication between an inner portion in which the voice coil is inserted and an outer portion.

In the above-mentioned speaker, the engagement portion of the magnetic circuit section to be put in the voice coil provided projectingly on the diaphragm has the through hole for communication between the inside portion located on the voice coil side and the outside portion. Accordingly, air communicates via this through hole to make the voice coil and the magnetic circuit section easily perform relative motion, and therefore, a satisfactory sound can be produced with a reduced consumption of power.

In one embodiment of the present invention, the diaphragm, the magnetic circuit section and the inertial member mainly resonate making air communication via the through hole of the first elastic plate when a frequency of an output sound of the speaker is not higher than 250 Hz, and the diaphragm, the air in the front chamber located between the first elastic plate and diaphragm and the air in the rear chamber located between the first elastic plate and the second elastic plate mainly resonate when the frequency exceeds 250 Hz.

In the above-mentioned speaker, by selecting the material and the thickness of the diaphragm, the first elastic plate and the second elastic plate and selecting the mass of the magnetic circuit section and the inertial member and the dimension of the through hole, the low frequency region described in connection with the speaker of the present invention is set to a frequency of not higher than 250 Hz, and the intermediate and high frequency region is set to a frequency exceeding 250 Hz. Therefore, the constituent members of this speaker and the air in the front and rear chambers also operate similarly to the description of the present invention. Therefore, even if the speaker is downsized so as to be applied to portable communication equipment, there can be produced satisfactory low-pitched sound lower than 250 Hz and intermediate- and high-pitched sound higher than 250 Hz, and the speaker can be used without any problems in a bad environment of air that includes dust or the like.

In one embodiment of the present invention, a sound is produced by the vibrations of the first elastic plate accompanied by communication of air in the front chamber and the rear chamber via the through hole of the first elastic plate when an output sound has a low frequency and by resonance of the air in the front chamber and the rear chamber when the output sound has a high frequency.

In the above-mentioned speaker, there is division into the low frequency region and the high frequency region across a boundary of, for example, 500 Hz. Sound is produced in the low frequency region by the vibrations of the first elastic plate accompanied by the mutual communication of air in the front chamber and the rear chamber via the through hole of the first elastic plate, and a sound is produced in the high frequency region by the resonance of the air in the front chamber and the rear chamber. Therefore, the constituent members of this speaker and the air in the front and rear chambers also operate similarly to the description of the present invention. Therefore, even if the speaker is downsized so as to be applied to portable communication equipment, there can be produced satisfactory low-pitched sound and high-pitched sound, and the speaker can be used without any problems in a bad environment of air that includes dust or the like.

In one embodiment of the present invention, the magnetic circuit section has a flange portion to be engaged with the casing with interposition of a small gap at an end portion located on the diaphragm side.

In the above-mentioned speaker, the flange portion to be engaged with the casing with interposition of a small gap is provided at the end portion, which belongs to the magnetic circuit section and is located on the diaphragm side. Therefore, if the speaker falls down or suffers impact, then the flange portion abuts against the inner wall of the casing to stop the movement of the magnetic circuit section. Therefore, the first elastic plate, which fixes the magnetic circuit section to the casing, is not excessively deformed, and the first elastic plate can be prevented from being damaged. It is to be noted that the shortage of mutual communication of the air in the front and rear chambers due to the small gap can be compensated for by increasing the diameter of the through hole provided in the engagement portion with the voice coil of the magnetic circuit section of the aforementioned embodiment.

In one embodiment of the present invention, the magnetic circuit section is fixed to the center hole of the disk in a position of the center of gravity of the magnetic circuit section.

In the above-mentioned speaker, the magnetic circuit section, which vibrates through an interaction with the voice coil, is fixed on the inner peripheral wall of the casing via the disk located in the position of the center of gravity of the magnetic circuit section. Therefore, the vibrations of the magnetic circuit section is stabilized by the well-balanced support, and a satisfactory sound can be produced.

In one embodiment of the present invention, the magnetic circuit section has a shape of plane symmetry with respect to the disk, and a bottom portion of the casing is sealed with the diaphragm.

In the above-mentioned speaker, the diaphragm with the voice coil projecting inward is provided on the front surface and the bottom portion of the casing, and the engagement portion of the magnetic circuit section, which has a shape of plane symmetry with respect to the disk, is put in each voice coil. Therefore, the magnetic circuit section supported with good balance stably vibrates and produces a satisfactory sound, allowing a large sound output to be obtained while downsizing the speaker.

In one embodiment of the present invention, the casing has a bottom portion sealed with the second elastic plate, defining the rear chamber between the second elastic plate and the first elastic plate.

In the above-mentioned speaker, the bottom portion of the casing is sealed with the second elastic plate, and the rear chamber is formed between this second elastic plate and the first elastic plate. Therefore, particularly when the air in the front chamber and the air in the rear chamber communicate with each other via the arc-shaped grooves of the first elastic plate, the first elastic plate smoothly vibrates while producing a buffering effect. The vibrations are transmitted to the second elastic plate that seals the end of the rear chamber, and the vibrations of the second elastic plate are transmitted to the casing, allowing a low-pitched sound of a large output to be obtained.

In one embodiment of the present invention, the casing and the diaphragm are made of a waterproof material, and a bottom portion of the casing is made of an elastic material to be elastically deformed so that a pressure of the back surface chamber becomes equal to an external pressure.

In the above-mentioned speaker, the casing and the diaphragm are made of a waterproof material. Therefore, so long as one surface of the second elastic plate is not exposed to the outside, the constituent members of the speaker are all housed in the casing sealed with the diaphragm and the casing bottom portion, which are made of a waterproof material. Therefore, the speaker can be used without any problems in a bad environment of not only air that includes dust but also underwater, high humidity or the like. Moreover, the casing bottom portion made of an elastic material is elastically deformed and pressed inward in accordance with an increase in water depth similarly to the diaphragm located on the front surface of the casing, consequently equalizing the pressure of the back surface chamber to the external pressure. Therefore, the rear chamber and the back surface chamber, which are partitioned depthwise by the second elastic member, come to have same external pressure. Therefore, the movement of the second elastic member on which the inertial member is fixed is not hindered dissimilarly to the casing bottom portion that is not elastically deformed and therefore the rear chamber has a pressure higher than that of the back surface chamber, and a satisfactory sound can be produced even in deep water.

In one embodiment of the present invention, the casing and the diaphragm are made of a waterproof material.

In the above-mentioned speaker, the casing and the speaker are made of a waterproof material. Therefore, similarly to the aforementioned case, the constituent members in the casing are insulated from the bad environment of not only air that includes dust but also underwater, high humidity or the like and is able to be used without any problems.

In one embodiment of the present invention, the voice coil is comprised of a first coil to which an electrical signal corresponding to a sound is inputted and a second coil to which an electrical signal corresponding to an alarm sound and vibrations for message arrival information are inputted.

In the above-mentioned speaker, a sound is produced from the first coil of the voice coils, and an alarm sound and vibrations for message arrival information are produced from the second coil of the voice coils. Therefore, with this speaker built in portable communication equipment of a portable telephone or the like, there can be achieved not only exchanging verbal communications but also easily perceiving the message arrival. Moreover, since the second coil is added, the output sound pressure can be increased.

Also, there is provided a portable communication device, whose main body casing is provided with the speaker as described above.

The portable communication equipment of the present invention is able to provide a dustproof function for the entire portable communication equipment including the speaker by mounting the speaker airtight with the surface of the diaphragm exposed to the speaker opening of the main body casing or provide a waterproof function by making the main body casing of a waterproof material and mounting the speaker watertight in a similar manner. With the downsized inexpensive speaker excellent in sound performance, the portable communication equipment can be downsized and reduced in cost.

In one embodiment of the present invention, in the portable communication device, the speaker is watertightly mounted on a main body casing.

The portable communication equipment for underwater use enables a satisfactory sound to be heard from the speaker provided watertight with the downsizing and the cost reduction of the portable communication equipment.

BEST MODE FOR CARRYING OUT THE INVENTION

Figure 1:
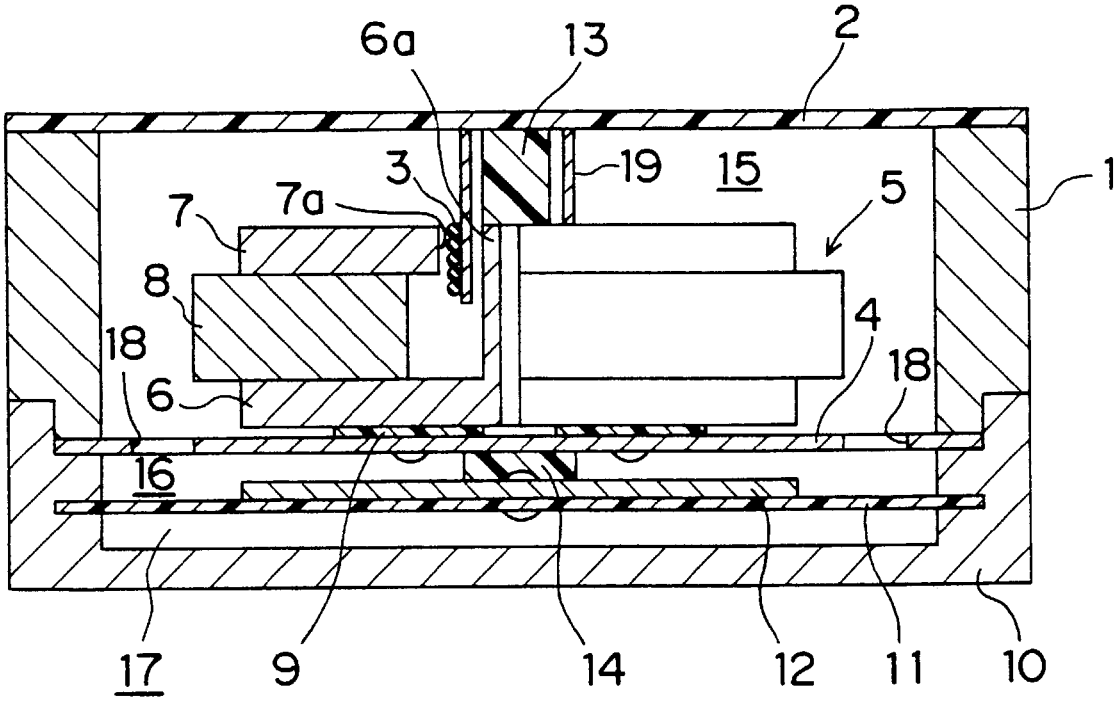
FIG. 1 is a longitudinal sectional view of one embodiment of the speaker of the present invention.

The present invention will be described in detail below on the basis of the embodiments shown in the drawings.

FIG. 1 is a longitudinal sectional view of one embodiment of the speaker of the present invention. This speaker is provided with a cylindrical casing 1 made of a waterproof material, a diaphragm 2 that is made of plastic as a waterproof material and fixed so as to seal the inside of the casing by covering the upper surface of this casing 1, a voice coil 3 provided projectingly at the center of the inner surface of this diaphragm 2, a first elastic plate 4, which is made of metal as an elastic material and is provided with its outer periphery fixed to the lower end of the casing 1 so as to oppose to the diaphragm 2, and a magnetic circuit section 5, which is constituted by interposing an annular permanent magnet 8 between a disk-shaped lower plate 6 with a columnar engagement portion 6*a* that is provided projectingly and put in the voice coil 3 and a disk-shaped upper plate 7 that has a center hole 7*a* put around the voice coil 3 and fixed on the first elastic plate 4 via a spacer plate 9.

At the lower end of the casing 1 is watertightly connected a casing rear cover 10, which is made of a waterproof material that is elastically deformed upon receiving an external water pressure, and a second elastic plate 11 made of plastic as an elastic material has its outer periphery fixed on this casing rear cover 10 oppositely to the first elastic plate 4. An inertial member 12 made of stainless steel is fixed on the upper surface of the second elastic plate 11. This inertial member 12 and the first elastic plate 4 are connected to each other with a second connecting member 14 made of plastic as an elastic material. On the other hand, the engagement portion 6*a* of the magnetic circuit section 5 and the diaphragm 2 are connected to each other with a first connecting member 13 made of plastic as an elastic material.

Inside the casing 1 sealed with the diaphragm 2 and the casing rear cover 10 is partitioned into a front chamber 15, a rear chamber 16 and a back surface chamber 17 depthwise in this order by the first and second elastic plates 4 and 11. The first elastic plate 4 is provided with a plurality of through holes 18, which make the front chamber 15 and the rear chamber 16 communicate with each other and are provided at specified intervals in the circumferential direction.

A magnetic flux, which flows through the magnetic circuit section 5, intersects a magnetic flux caused by a signal current that flows through the voice coil 3 wound around the outer periphery of the lower portion of an aluminum bobbin 19. The diaphragm 2 with the voice coil 3 provided projectingly performs relative motion in the vertical direction with respect to the magnetic circuit section 5 connected to the diaphragm via the first connecting member 13 and the first elastic plate 4, the second connecting member 14, the inertial member 12 and the second elastic plate 11, which are indirectly connected to this, producing a sound corresponding to the signal current.

The thickness of the diaphragm 2 made of plastic is set to 2 mm or less, and the material (flexibility) and the thickness of the first elastic plate 4 made of metal are selected so as to conform to the mass of the magnetic circuit section 5. The second elastic plate 11 is made thinner than the first elastic plate 4. The mass of the inertial member 12 made of stainless steel, the materials of the first and second connecting members 13 and 14 made of plastic and the amount and diameter of the through holes 18 of the first elastic plate 4 are properly selected. In a low frequency region of not higher than 250 Hz, air in the front chamber 15 and air in the rear chamber 16 communicate with each other through the through holes 18, so that the diaphragm 2, the first elastic plate 4 on which the magnetic circuit section 5 is fixed and the second elastic plate 11 which is connected to the first elastic plate 4 via the second connecting member 14 and on which the inertial member 12 is fixed mainly resonate. In an intermediate and high frequency region exceeding 250 Hz, there is scarce communication of air via the through holes 18, and the second elastic plate 11 on which the inertial member 12 is fixed scarcely vibrates, so that the diaphragm 2 and the air in the front chamber 15 and the rear chamber 16 mainly resonate.

It is to be noted that the resonance frequency can easily be changed by changing the diameter of the through holes 18.

For the plastic material of the diaphragm 2, there can be used urethane rubber, silicone rubber, polypropylene resin, polyethylene resin or the like. The voice coil 3, which is fixed on the diaphragm 2 by the adhesion of the upper end of the aluminum bobbin 19, can also be provided by an air-core coil or formed integrally with the diaphragm 2 by printing or etching as in the case of a multilayer substrate of a polyimide-based resin.

For the first and second connecting members 13 and 14, there can be used a plastic material of urethane rubber, silicone rubber, polypropylene resin, polyethylene resin or the like. Although sponge is especially preferable in relation to displacement and a restoration force, a metallic spring of stainless steel, aluminum, steel or the like can also be used. For the second elastic plate 11, there can be used a plastic material of urethane rubber, silicone rubber, polypropylene resin, polyethylene resin or the like. However, the plate may be provided by a thin metal plate of stainless steel, aluminum, steel or the like. Moreover, the material of the inertial member 12 is not limited to stainless steel and permitted to be made of aluminum or steel.

The speaker having the aforementioned construction operates as follows.

When a signal current corresponding to a sound flows through the voice coil 3, which is provided projectingly at the center of the inner surface of the diaphragm 2 and intersects the magnetic flux of the magnetic circuit section 5 provided with the permanent magnet 8, the diaphragm 2 performs relative motion in the vertical direction with respect to the magnetic circuit section 5 connected to the diaphragm via the first connecting member 13 and the first elastic plate 4, the second connecting member 14, the inertial member 12 and the second elastic plate 11 fixed to this via the spacer plate 9, producing a sound corresponding to the signal current.

The mode of the relative motion differs depending on the frequency of the produced sound. In the low frequency region of not higher than 250 Hz, the air in the front chamber 15 and the air in the rear chamber 16 communicate with each other via the through holes 18, so that the diaphragm 2, the first elastic plate 4 on which the magnetic circuit section 5 is fixed and the second elastic plate 11 which is connected to this via the second connecting member 14 and on which the inertial member 12 is fixed mainly resonate. In the intermediate and high frequency region exceeding 250 Hz, there is scarce communication of air via the through holes 18, and the second elastic plate 11 on which the inertial member 12 is fixed scarcely vibrates, so that the diaphragm 2 and the air in the front chamber 15 and the rear chamber 16 mainly resonate.

The reason why the second elastic plate 11 on which the inertial member 12 is fixed resonates in the low frequency region is as follows. By virtue of the provision of the through holes 18 of the first elastic plate 4, the air in the front chamber 15, which tries to dynamically move in accordance with the vibrations of the magnetic circuit section 5, communicates between the chamber and the rear chamber 16 via the through holes 18. Therefore, the vibration sound of the vibrations causes cavity resonance with the first elastic plate 4 and the through holes 18, producing vibrations and a vibration sound at a low frequency. This enables the resonance at a specific frequency corresponding to the amount and the diameter of the through holes 18 and the mass of the magnetic circuit section 5, so that the second elastic plate 11 on which the inertial member 12 is fixed moves vertically together with the magnetic circuit section 5. On the other hand, the mass of the magnetic circuit section 5 becomes greater relative to the frequency. Consequently, the magnetic circuit section 5 cannot follow the vibrations, the air in the front chamber 15 does not move dynamically, and there is scarce communication of air via the through holes 18. Therefore, the second elastic plate 11 on which the inertial member 12 is fixed does not resonate.

As described above, in the aforementioned speaker, the diaphragm 2, the first elastic plate 4 on which the magnetic circuit section 5 is fixed and the second elastic plate 11 on which the inertial member 12 is fixed mainly resonate in the low frequency region, while the diaphragm 2 and the air in the front chamber 15 and the rear chamber 16 mainly resonate in the intermediate and high frequency region. Therefore, a satisfactory sound can be produced by resonance in all the frequency regions. The air in the casing generate no distortion by the vibrations of the diaphragm even if the speaker is downsized dissimilarly to the conventional speaker for diver use, and therefore, a satisfactory sound can be produced even if the speaker is downsized.

Moreover, in the aforementioned speaker, the upper and lower ends of the waterproof casing 1 are sealed respectively with the diaphragm 2 made of waterproof plastic and the casing rear cover 10 made of a waterproof material that is elastically deformed. If this speaker is sunk in water, not only the diaphragm 2 but also the casing rear cover 10 are elastically deformed and pressed toward the casing in accordance with an increase in water depth, and therefore, the pressure of the back surface chamber 17 can be equalized to the pressure of the front chamber 15 and the rear chamber 16 connected to this via the through holes 18, i.e., to the water pressure corresponding to the water depth. If the casing rear cover 10 is made of a material that is not elastically deformed, then the back surface chamber 17 remains at the atmospheric pressure when the speaker is manufactured. The second elastic plate 11 is depressed by the water pressure on the rear chamber 16 side, and the vertical movement of the inertial member 12 when a low-pitched sound is produced is hindered. However, the aforementioned speaker does not have the above phenomenon, and a satisfactory sound can be produced even in deep water.

The casing rear cover 10, which is elastically deformed, similarly operates not only in water but also in an environment of a significant temperature change such that a pressure difference possibly occurs between the rear chamber 16 and the back surface chamber 17 but also in an environment of a significant air pressure change as in an aircraft and is able to produce a satisfactory sound.

If the casing rear cover 10 is made of a material that is not elastically deformed, there is no change in the fact that the inside of the casing 1 is sealed. Therefore, this speaker, all the constituent members of which are housed in the casing 1, can be protected from a bad environment of air that includes dust, salt, corrosion gas or the like, and a satisfactory sound quality can be maintained.

Figure 2:
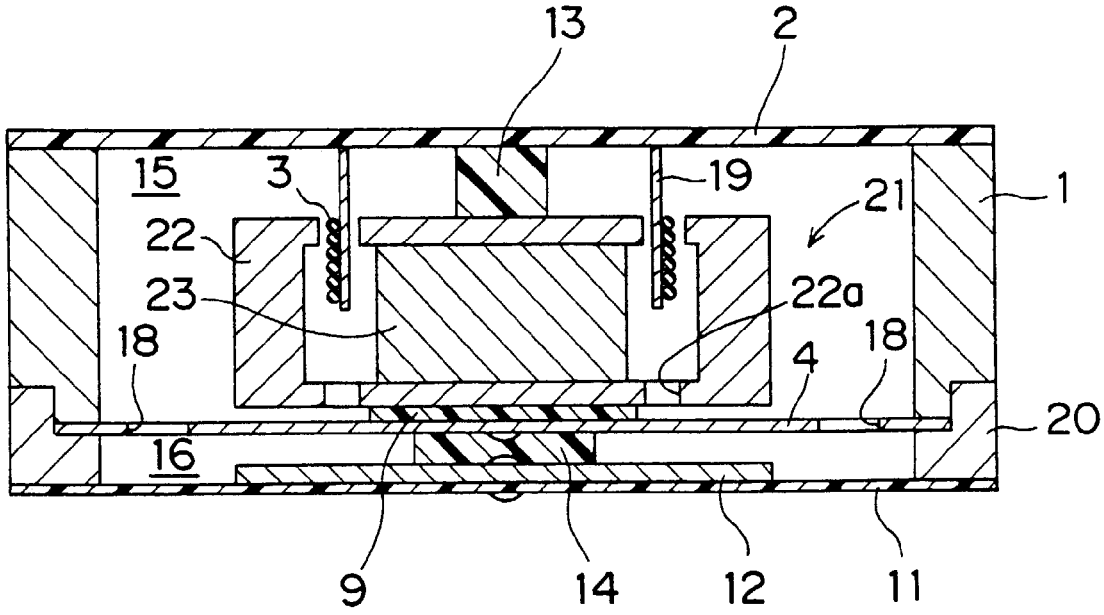
FIG. 2 is a longitudinal sectional view of the other embodiment of the speaker of the present invention.

FIG. 2 is a longitudinal sectional view showing another embodiment of the speaker of the present invention. This speaker has the same construction as that of the speaker described with reference to FIG. 1 except that the second elastic plate 11 is exposed on the lower surface of the casing and the magnetic circuit section 21 has a varied form. The same members are denoted by the same reference numerals, and no description is provided therefor.

The second elastic plate 11 is provided so as to seal the inside of the casing 1 with its outer periphery fixed to the lower end of a short cylindrical bottomless casing lower member 20. The casing 1 is internally partitioned depthwise into a front chamber 15 and a rear chamber 16 by a first elastic plate 4 provided with through holes 18, and the back surface chamber 17 of FIG. 1 is not provided.

The magnetic circuit section 21 is constructed of a permanent magnet 23 that serves as an engagement portion to be put in a voice coil 3 wound around the outer periphery of the lower portion of an aluminum bobbin 19 that has a diameter larger than that of FIG. 1 and a lower plate 22 that has a central bottom portion on which this permanent magnet 23 is fixed and has an annular outer peripheral wall put around the voice coil 3. The central bottom portion opposite to the voice coil 3 is provided with a plurality of through holes 22*a* for communication between the inside and the outside. The magnetic circuit section 21 is fixed to a diaphragm 2 and a first elastic plate 4 respectively via a disk made of the same material as that of the lower plate fixed to the upper end of the permanent magnet and a first connecting member 13 and a spacer plate 9 located on the lower plate 22.

In the aforementioned speaker, the large-diameter voice coil 3 is internally and externally surrounded by the pot-shaped magnetic circuit section 21. However, by virtue of the provision of through holes 22*a* at the bottom portion of the lower plate 22 opposite to the voice coil 3, air communicates between the inside and the outside via the through holes 22*a* when the voice coil 3 and the magnetic circuit section 21 performs vertical relative motion, and the vertical relative motion becomes smooth without being hindered. Therefore, a satisfactory sound can be produced while suppressing the consumption of power.

In the aforementioned speaker, the casing rear cover 10 of FIG. 1 is merely replaced by the second elastic plate 11 eliminating the casing rear cover 10, and the operation of each constituent member does not differ from the speaker of FIG. 1 at all.

Therefore, also in the aforementioned speaker, the diaphragm 2, the first elastic plate 4 on which the magnetic circuit section 5 is fixed and the second elastic plate 11 on which the inertial member 12 is fixed mainly resonate in the low frequency region, while the diaphragm 2 and the air in the front chamber 15 and the rear chamber 16 mainly resonate in the intermediate and high frequency region. Consequently, a satisfactory sound can be produced by resonance in all the frequency regions even if the speaker is downsized.

Moreover, the aforementioned speaker, which does not have the back surface chamber 17 of FIG. 1, is allowed to have a reduced amount of members by that much and allowed to be further downsized. Since all the constituent members are housed in the casing 1 sealed with the diaphragm 2 and the second elastic plate 11, the speaker can be used without any problems even in a bad environment of air that includes dust or the like.

Furthermore, if the second elastic plate 11 is made of a metal such as aluminum that has a waterproof property and is elastically deformed by a water pressure, then it is allowed to obtain a speaker, which produces a satisfactory sound even in deep water while promoting further downsizing and cost reduction with the casing rear cover 10 of FIG. 1 eliminated.

Figure 3:
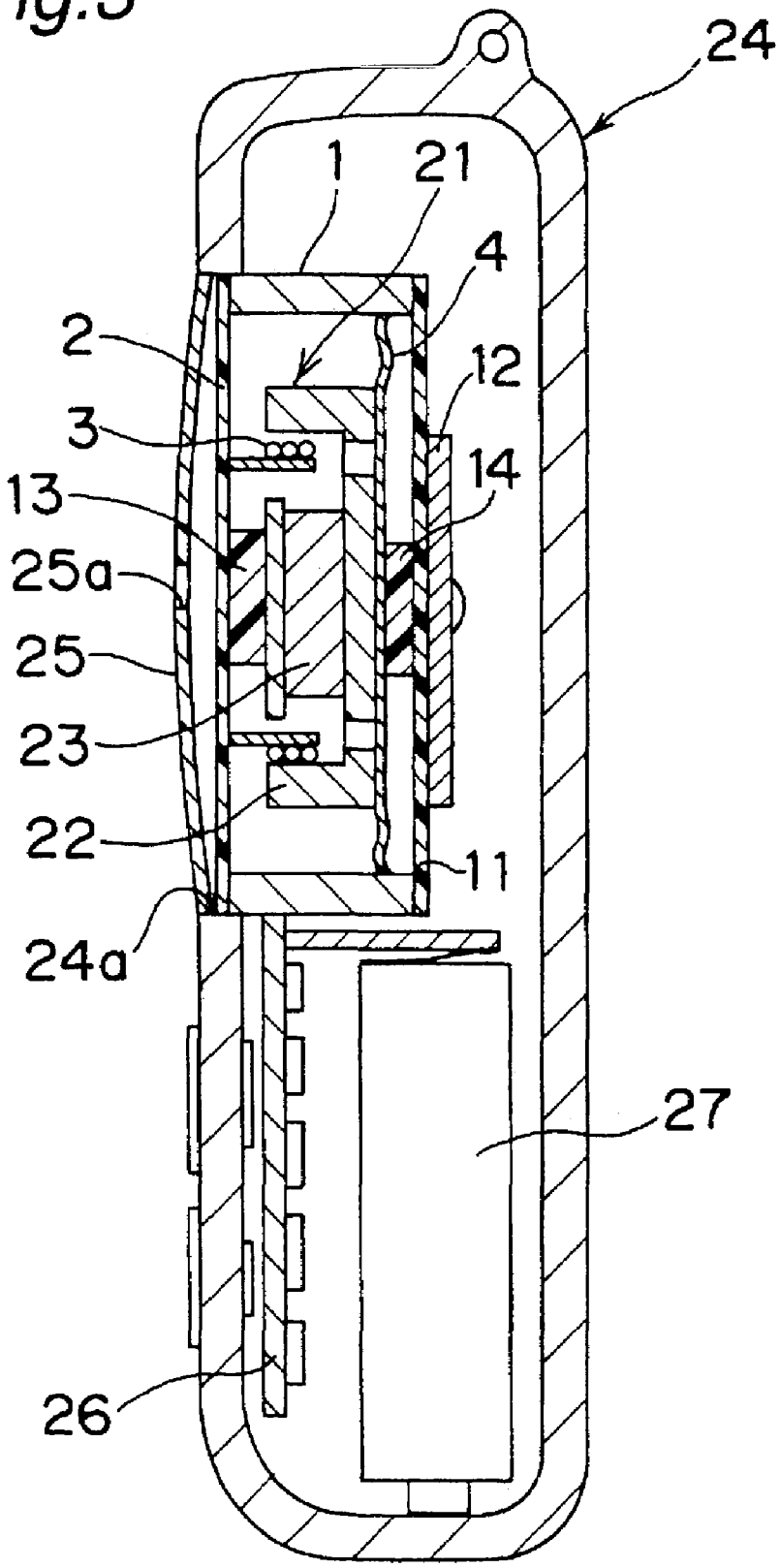
FIG. 3 is a longitudinal sectional view of a pager that serves as one example of the portable communication equipment provided with the above speaker.

FIG. 3 is a longitudinal sectional view of a pager (message transmitter-receiver) as one example of the portable communication equipment provided with the speaker of the aforementioned embodiment. In this pager, a speaker, which has a pot-shaped magnetic circuit section 21 similar to that of FIG. 2 and of which the second elastic plate 11 is exposed inside the main body casing, is mounted in a speaker opening 24*a* located in an upper portion of the main body casing 24, a printed circuit board 26 and a battery 27 are housed in a lower portion of the main body casing, and the front surface of the diaphragm 2 fit in the speaker opening 24*a* is covered with a windshield 25 provided with through holes 25*a*.

The speaker has the same structure as that of the speaker of FIG. 2 except that the inertial member 12 is fixed on the rear surface of the second elastic plate 11, and the constituent members are denoted by the same reference numerals as those of FIG. 2.

The windshield 25 prevents the diaphragm 2 from coming in direct contact with the air outside and enables the sound pressure of a sound at a specified frequency to be increased by causing a cavity resonance with air with the diameter of the through holes 25*a* set at a prescribed value. Particularly when the diameter of the through holes 25*a* and the internal cavity volume are selected so as to resonate with a sound at a frequency of 1 kHz to 5 kHz, a ringing tone with a high sound pressure can be generated.

The speaker hermetically mounted in the main body casing 24 of the pager of FIG. 3 can be downsized and operates in a manner as described with reference to FIG. 2. Therefore, the speaker is able to be used without any problems even in a bad environment of air that includes dust or the like, generate a satisfactory sound by resonance throughout all the low, intermediate and high frequency regions, and allows the pager itself to be downsized and reduced in cost.

Moreover, if the speaker is watertightly mounted in the main body casing 24 made of a waterproof material, then a pager, which is excellent in sound quality and able to be used even in water or a high humidity environment, can be obtained.

Figure 4A:
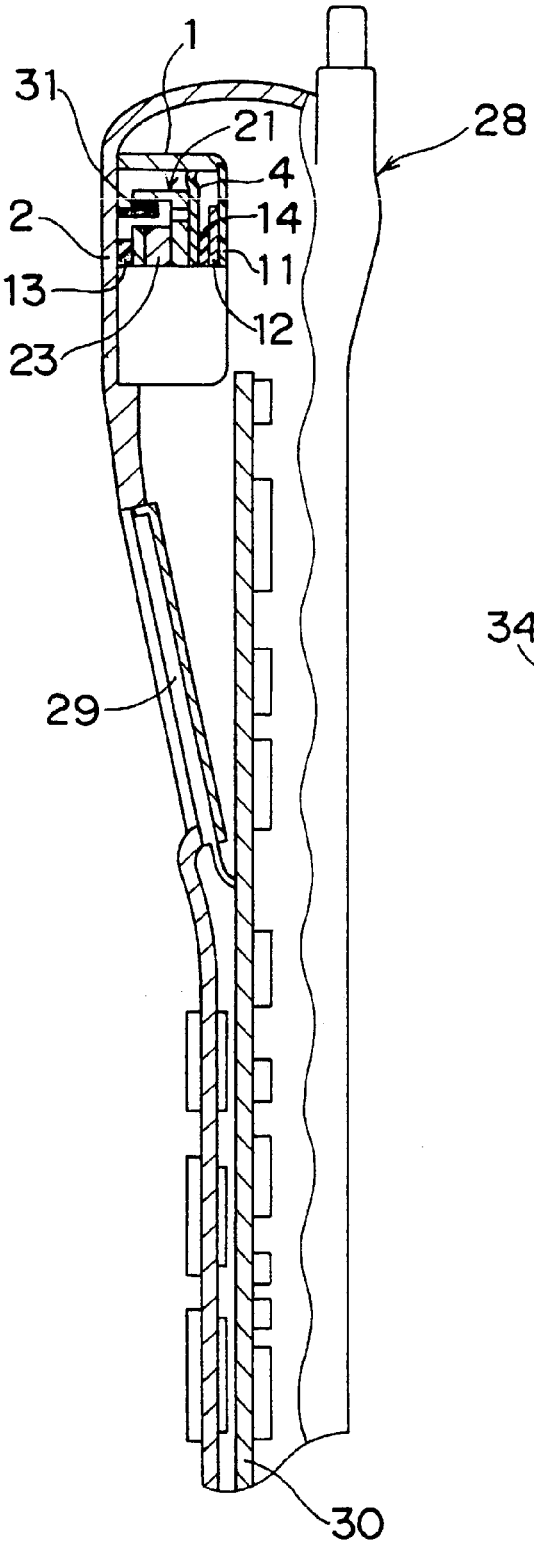
FIGS. 4A and 4B are a longitudinal sectional view of a transceiver that serves as the portable communication equipment provided with the above speaker and a circuit diagram of an electric circuit for supplying a signal current to the voice coil of the speaker.

FIG. 4A is a longitudinal sectional view of a transceiver that serves as one example of the portable communication equipment provided with the speaker of the aforementioned embodiment. In this transceiver, a diaphragm 2 made of the same plastic material as that of this main body casing is formed integrally with the upper portion of the main body casing 28, and a speaker of the same structure as that of FIG. 2 is mounted in the casing. The same constituent members of the speaker are denoted by the same reference numerals as those of FIG. 2.

A liquid crystal display panel 29 is provided below the speaker of the transceiver, and a printed circuit board 30 is housed in the main body casing 28.

Figure 4B:
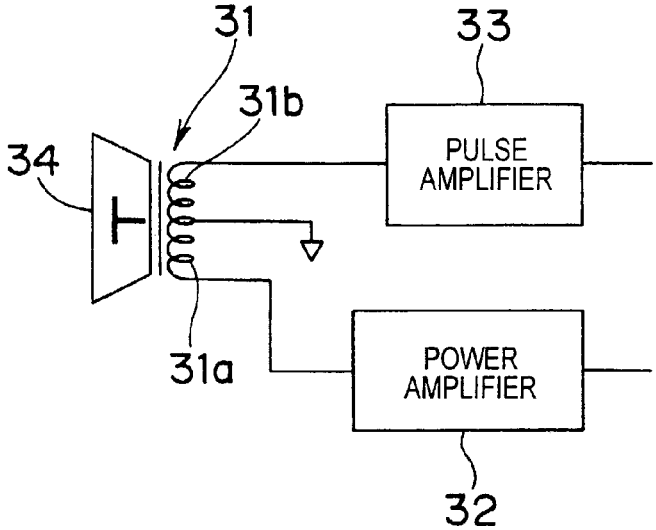

FIG. 4B shows an electric circuit for supplying a signal current to the voice coil 31 of the speaker of FIG. 4A. The voice coil 31 is constructed of a first coil 31*a* to which a signal current corresponding to a sound is supplied from a power amplifier 32 and a second coil 31*b* to which a signal current corresponding to vibrations for message arrival information is supplied from a pulse amplifier 33. This voice coil 31 vibrates a sound producing section 34, in which the diaphragm 2, the first elastic plate 4 on which the magnetic circuit section 21 is fixed and the second elastic plate 11 on which the inertial member 12 is fixed are integrated.

Therefore, the speaker including the first coil 31*a* and the second coil 31*b* plays the role of producing a sound in the low, intermediate and high frequency regions and generating pulse vibrations, and the whole main body casing 28 integrated with the diaphragm 2 plays the role of increasing the produced sound and generated pulses and emitting the same.

With the transceiver of FIG. 4A, the user senses the sound and the message arrival information vibrations, which are produced by the first coil 31*a* and the second coil 31*b* of the speaker and emitted from the whole main body casing 28 while being enhanced. Therefore, the user can easily perceive the message arrival in addition to the sound.

A pulse current signal corresponding to the alarm sound and audio sound can be supplied from the pulse amplifier 33 to the second coil 31*b*, by which the user can be informed of a specified warning, and the sound pressure of the audio sound can be increased to 100 dB or more.

Moreover, the aforementioned transceiver is able to be used without any problems in a bad environment of air that includes dust or the like similarly to the pager of FIG. 3, produce a satisfactory sound by resonance throughout all the low, intermediate and high frequency regions and achieve the downsizing and cost reduction of the transceiver itself. If the speaker is watertightly mounted in the main body casing 28 made of a waterproof material, then the transceiver can, of course, be used in water or a high humidity environment.

Figure 5A:
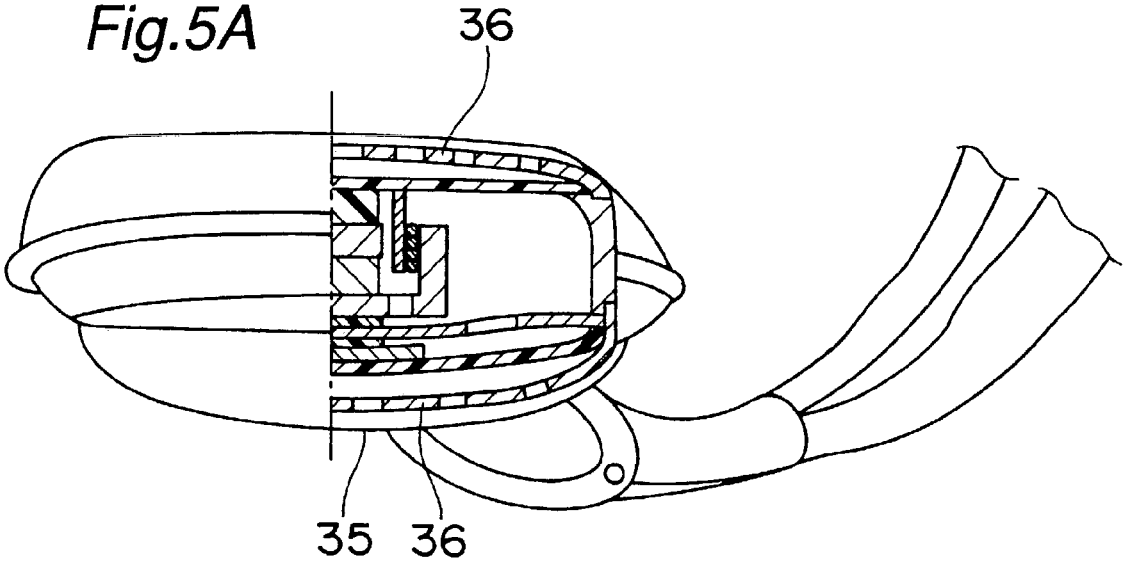
FIGS. 5A and 5B are a half cross-sectional view of a waterproof headphone that serves as the portable communication equipment provided with the above speaker and a detailed sectional view of the speaker.
Figure 5B:
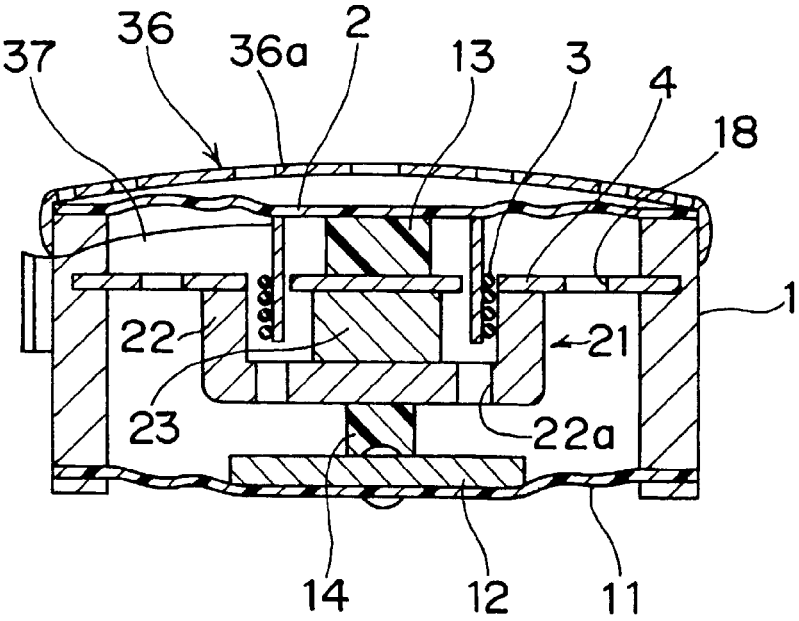

FIGS. 5A and 5B are a half cross-sectional view of a waterproof headphone that serves as the portable communication equipment provided with the speaker of the aforementioned embodiment and a detailed sectional view of the speaker. In this waterproof headphone, a speaker whose upper and lower surfaces are covered with a protective cover 36 provided with a plurality of through holes 36*a* as shown in FIG. 5B is watertightly mounted in a main body casing 35 that has an opening on one surface and a wholly waterproof structure.

The above-mentioned speaker is similar to the speaker described with reference to FIG. 2 and differs in that the magnetic circuit section 21 is fixed on the lower surface of the first elastic plate 4. That is, in the magnetic circuit section 21, the upper end of the annular outer peripheral wall of the lower plate 22 put around the voice coil 3 and the upper end of the permanent magnet 23, which is fixed to the bottom portion at the center of the lower plate that has the through holes 22*a* and put in the voice coil 3, are fixed on the lower surface of the first elastic plate 4 that has the through holes 18. The upper end of the permanent magnet 23 is connected to the diaphragm 2 via the first elastic plate 4 and the first connecting member 13, while the lower end of the magnetic circuit section 21 is connected to the second elastic plate 11 that covers the lower surface of the casing 1 via the second connecting member 14 and the inertial member 12. It is to be noted that the reference numeral 37 denotes a signal line for supplying a signal current to the voice coil 3.

The waterproof headphone of the aforementioned construction has the opening on one surface, and the peripheral edge of the opening and the peripheral edge of the speaker housed inside are watertightly sealed as shown in FIG. 5B. Therefore, no water enters the inside even if the speaker is used in water, securing a completely waterproof structure. Moreover, a sound producing section constructed of the diaphragm 2 provided with the voice coil, the first elastic plate 4 on which the magnetic circuit section 21 is fixed and the second elastic plate 11 on which the inertial member 12 is fixed has the same structure as that of the sound producing section of FIG. 2 except that the magnetic circuit section 21 is fixed on the lower surface of the first elastic plate 4.

Therefore, this waterproof headphone is able to be further downsized and operate in a manner similarly to the description with reference to FIG. 2, allowing the user to listen to music even in water while swimming with the speaker that produces a satisfactory sound throughout all the low, intermediate and high frequency regions by resonance. Moreover, there is an advantage that the diaphragm 2 is protected from the collision of an external foreign body, user's fingers and so on since the upper and lower surfaces of the speaker are covered with the protective cover 35, and the speaker is protected from impact due to an external force.

Figure 6:
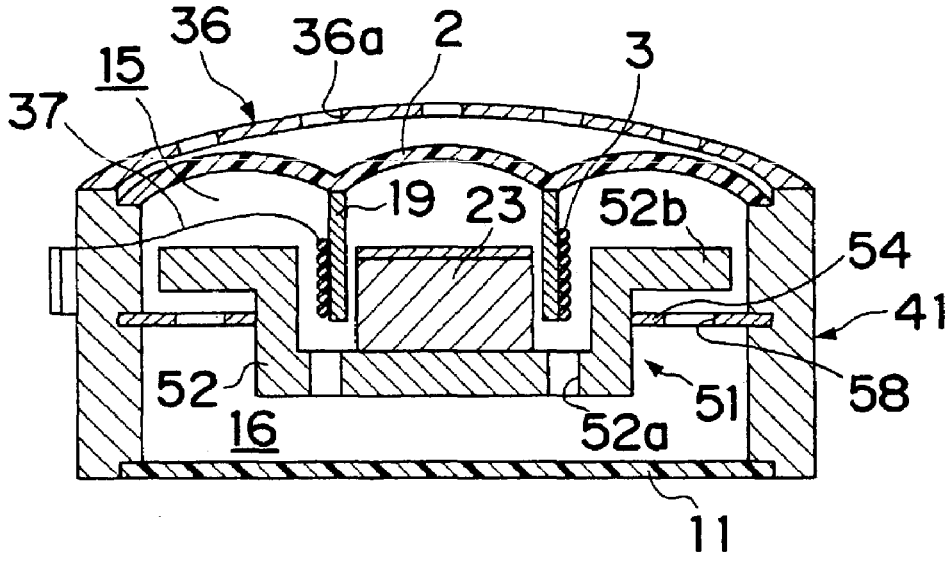
FIG. 6 is a longitudinal sectional view showing another embodiment obtained by removing the first and second connecting members and the inertial member from the speaker of FIG. 5B.

FIG. 6 is a longitudinal sectional view of another embodiment obtained by removing the first and second connecting members 13 and 14 and the inertial member 12 from the speaker of FIG. 5B. The same members as those of FIG. 5B are denoted by same reference numerals, and no description is provided therefor.

The structure of this speaker is the structure applied to one of a smaller size (having a diameter of 16 mm, for example) than that of FIG. 5B, from which the first connecting member (13 in FIG. 5B) that connects the diaphragm 2 with the permanent magnet 23, the inertial member (12 in FIG. 5B) located on the inner surface of the second elastic plate 11 and the second connecting member (14 in FIG. 5B) that connects this inertial member with a magnetic circuit section 51 are removed.

Figure 8A:
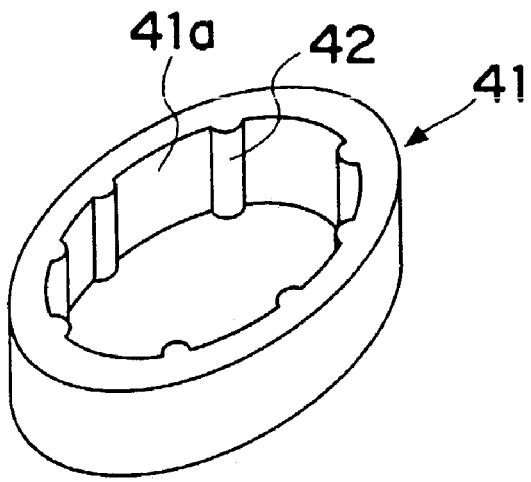
FIGS. 8A and 8B are a perspective view and a plan view of the casing of FIG. 6.
Figure 8B:
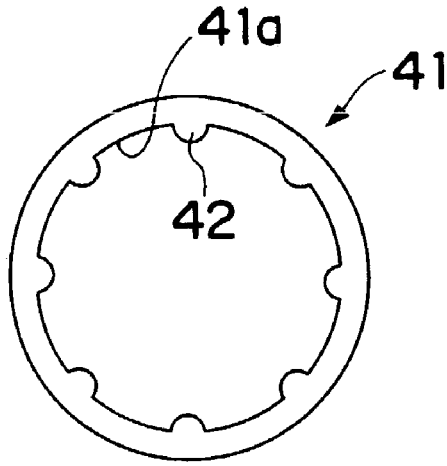

The magnetic circuit section 51 has through holes 52*a* in the bottom portion of a lower plate 52 put around the voice coil 3 similarly to that of FIG. 5B as well as a flange portion 52*b*, which is fit in a casing 41 with interposition of a small gap at the upper end of the annular outer peripheral wall of the lower plate 52. As shown in FIGS. 8A and 8B, the casing 41 is provided with six semicircular columnar projections 42 that project on a cylindrical inner peripheral wall 41*a* at regular intervals, and these projections 42 and the flange portion 52*b* are engaged with each other with interposition of a small gap. The reason for the provision of the projections 42 is to increase the gap between the inner peripheral wall 41*a* interposed between the projections 42 and 42 of the casing 41 and the outer periphery of the flange portion 52*b* for the reduction in the resistance of air in the front chamber 15 against the vibrations of the magnetic circuit section 51.

The magnetic circuit section 51 differs from that of FIG. 5B and is fixed on the inner peripheral wall of the casing 41 via only a first elastic plate 54. The first elastic plate 54, which is required to increase the buffering effect (suspension effect) in relation to the elimination of the first connecting member (13 in FIG. 5B), the inertial member (12 in FIG. 5B) and the second connecting member (14 in FIG. 5B), therefore has a gimbal configuration described later with reference to FIG. 7. As shown in FIG. 6, the magnetic circuit section 51 is fixed to a center hole 54*a* of the first elastic plate 54 in the position of the center of gravity of the magnetic circuit section, and three outermost peripheral portions 54*b* of the first elastic plate 54 are fixed to the inner peripheral wall 41*a* of the casing 41. The reason for the support of the magnetic circuit section 51 to the casing 41 via the first elastic plate 54 in the position of the center of gravity is to stabilize the vibrations of the magnetic circuit section 51 in accordance with an interaction with the voice coil 3 by well-balanced support for the obtainment of a satisfactory sound.

Figure 7:
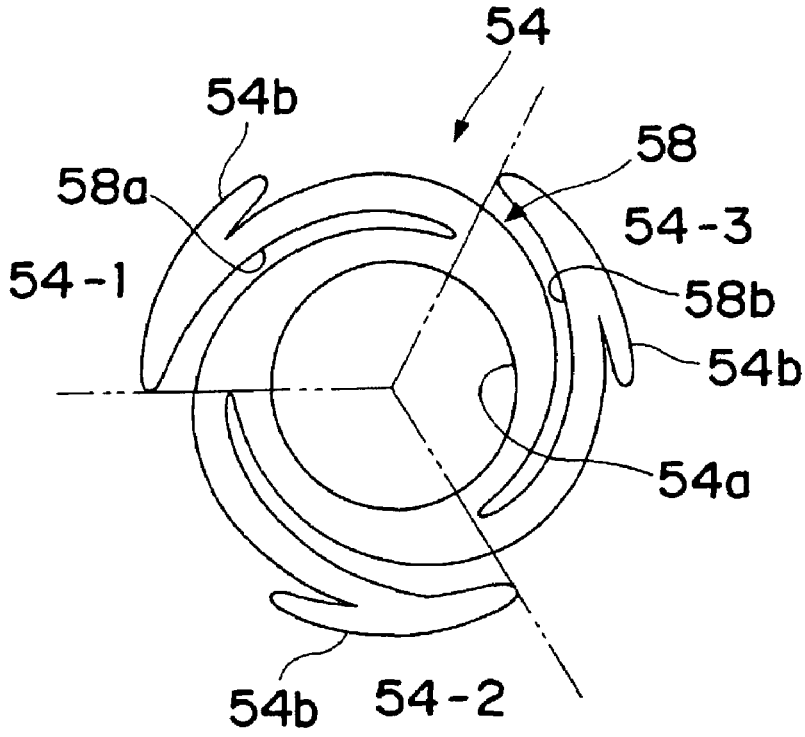
FIG. 7 is a plan view of the first elastic member of FIG. 6.

FIG. 7 is a plan view showing the gimbal configuration of the first elastic member 54. This first elastic member 54 is obtained by dividing a disk provided with a center hole 54*a* equally into three sectorial regions 54-1, 54-2 and 54-3 with an arc-shaped groove 58 that serves as a through hole provided in an identical shape for each sectorial region. This arc-shaped groove 58 is constructed of a first arc-shaped groove 58*a*, which is opened at one outer peripheral end (end located on the outermost peripheral portion 54*b* side) of the sectorial region 54-1 and extends in the circumferential direction roughly to the other end of this sectorial region 54-1 while approaching the center hole 54*a*, and a second arc-shaped groove 58*b*, which is opened at the other outer peripheral end of the sectorial region 54-1 and extends in the circumferential direction roughly to the other end of the sectorial region 54-3 whose one end is located adjacent to this other end while approaching the center hole 54*a*. The first elastic member 54, which has the gimbal configuration and a number of first and second arc-shaped grooves 58*a* and 58*b*, has a great buffering effect.

The speaker of the aforementioned construction operates as follows.

When a signal current flows through the voice coil 3 provided projectingly on the inner surface of the diaphragm 2, then the magnetic circuit section 51, which has the permanent magnet 23 and the lower plate 52 put in and around this voice coil 3 and is supported to the casing 41 via the first elastic plate 54, performs relative motion. In this case, the first elastic plate 54 has the gimbal configuration constructed of the three sets of arc-shaped grooves 58 described with reference to FIG. 7 and produces a great buffering effect. Therefore, in spite of the compactness by virtue of the elimination of the first connecting member 13, the inertial member 12 and the second connecting member 14 of FIG. 5B, the magnetic circuit section 51 properly vibrates without excessively responding to, in particular, the signal current at a low frequency. When the signal current has a low frequency, the air in the front chamber 15 and the air in the rear chamber 16, which are partitioned by the first elastic plate 54, communicate with each other via the arc-shaped grooves 58, in accordance with which the first elastic plate 54 vibrates. The vibrations are transmitted to the second elastic plate 11 that seals the bottom portion of the rear chamber 16, and the vibrations of the second elastic plate 11 further vibrate the casing 41, producing a satisfactory sound at the low frequency. When the signal current has a high frequency, the magnetic circuit section 51, the mass inertia of which becomes greater relative to the frequency, scarcely vibrates. There is scarce communication of air via the arc-shaped grooves 58, and the air in the front chamber 15 and the air in the rear chamber 16 resonate at a specific frequency according to the volume, producing a satisfactory sound at the high frequency. According to experimental results, a boundary between the low frequency and the high frequency existed at a frequency of, for example, 500 Hz. A large sound output was able to be obtained by resonance at a specific frequency of about 115 to 140 Hz on the low frequency side, and a large sound output was able to be continuously obtained by the continuous resonance of the air in the front and rear chambers up to a frequency of 3 kHz. It is to be noted that the resonance frequency can easily be changed with the buffering effect adjusted by changing the length in the circumferential direction and the total area of the arc-shaped grooves 58 of the first elastic plate 54.

As described above, according to the above-mentioned speaker, a sound is produced mainly by the vibrations of the first elastic plate 54 in the low frequency region and mainly by the resonance of the air in the front and rear chambers 15 and 16 in the high frequency region. Therefore, even if the speaker is downsized further than that of FIG. 5B so as to be applied to the portable communication equipment, satisfactory sounds can be produced throughout all the frequency regions. Furthermore, all the constituent members of the speaker are housed in the casing 41 sealed with the diaphragm 2 and the second elastic plate 11, and therefore, the speaker can be used without any problems even in a bad environment of air that includes dust or the like.

Furthermore, in the speaker of the aforementioned construction, the flange portion 52*b* to be fit to the inner periphery of the casing 41 is provided at the upper end of the lower plate 52 of the magnetic circuit section 51. Therefore, even if the speaker suffers impact due to falling or the like, the flange portion 52*b* abuts against the inner periphery of the casing to prevent the movement of the magnetic circuit section 51. Accordingly, there is an advantage that the first elastic plate 54, which has many arc-shaped grooves 58 that support the magnetic circuit section 51, is not excessively deformed, allowing the first elastic plate 54 to be prevented from being damaged. The phenomenon that the mutual communication of the air in the front and rear chambers is obstructed by the small gap can be alleviated by increasing the amount or the diameter of through holes 52*a* located in the bottom portion of the lower plate 52.

Additionally in the speaker having the aforementioned construction, the magnetic circuit section 51 is fixed on the first elastic plate 54 in the position of the center of gravity thereof and supported to the casing 41 via only this first elastic plate 54. Accordingly, there is an advantage that the vibrations of the magnetic circuit section 51 due to the interaction with the voice coil 3 become well balanced and stabilized, allowing a satisfactory sound to be produced.

It is to be noted that the outer peripheral edge of the speaker of FIG. 6 is watertightly sealed similarly to the one described with reference to FIG. 5B. Therefore, it is needless to say that water does not enter even if the speaker is used in water or high humidity and the speaker can be build in a waterproof headphone as shown in FIG. 5A.

In the embodiment of FIG. 6, the first connecting member 13, the inertial member 12 and the second connecting member 14 of FIG. 5B are all eliminated. However, it is acceptable to provide one or more of these members as the need arises.

Figure 9:
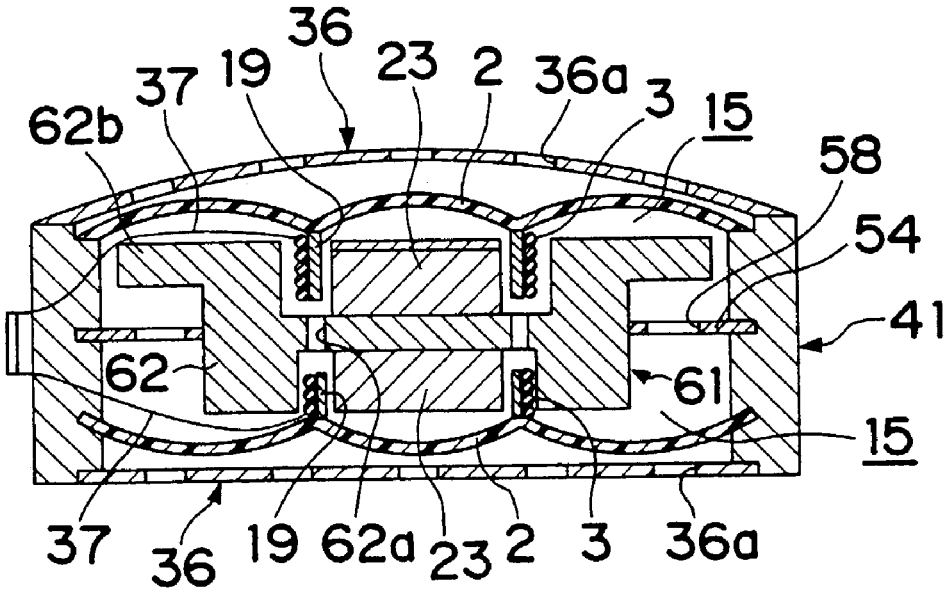
FIG. 9 is a longitudinal sectional view showing an embodiment of a speaker with diaphragms provided on the front surface and the bottom surface of the casing.

FIG. 9 is a longitudinal sectional view showing an embodiment of the speaker provided with diaphragms 2 and 2 on the front surface and the bottom surface of the casing 41. In this speaker, the bottom portion of the magnetic circuit section 51 of FIG. 6 is shifted upward, and the annular wall of the lower plate 52 is projected downward. A permanent magnet 23 is additionally provided as a magnetic circuit section 61 on the rear surface of the bottom portion surrounded by this annular wall, and the bottom portion of the casing 41 is sealed with the diaphragm 2 on which the voice coil 3 to be put around the permanent magnet 23 located in the lower portion is provided projectingly upward. The front and rear ends of the casing are covered with a protective cover 36. Therefore, the casing 41 sealed with the upper and lower diaphragms 2 and 2 is internally partitioned into upper and lower front chambers 15 and 15 by the first elastic plate 54. With regard to the voice coils 3 and 3 provided on the upper and lower diaphragms 2 and 2, one is connected as a first coil 31*a*, exemplified in FIG. 4B, to a power amplifier 32 that supplies an audio signal current, and the other one is connected as a second coil 31*b* to a pulse amplifier 33 that supplies a signal current for vibrations of message arrival information, via a signal line 37. The upper and lower voice coils 3 and 3, which serve as the first and second coils 31*a* and 31*b*, have coil winding directions or electrification directions set so that a power, which is two times greater than when only one of the coils operates, is exerted on the magnetic circuit section 61 when both of the coils are operated by same signal currents.

The speaker of the aforementioned construction differs from the embodiment of FIG. 6 only in that the diaphragms 2 provided with the permanent magnets 23 and the voice coils 3 are provided above and below the first elastic plate 58. Therefore, the same operation and effect as those described with reference to FIG. 6 are produced except for the peculiar effects described as follows.

That is, the diaphragm 2 provided with the upper voice coil 3 (31*a*) performs relative motion with respect to the magnetic circuit section 61 in accordance with the audio signal current, while the diaphragm 2 provided with the lower voice coil 3 (31*b*) performs relative motion in accordance with the signal current for vibrations of message arrival information. Therefore, similarly to the description described for the transceiver of FIG. 4A, the user can easily be informed of the arrival of a message by the vibrations of the casing in addition to telephonic communication sounds.

Same audio current signals can also be supplied to the upper and lower voice coils 3 and 3. If doing so, further downsizing can be achieved with the rear chamber eliminated, and a large sound output can be obtained as a consequence of the doubled amplitude of the diaphragm 2 in addition to the satisfactory frequency characteristic similar to the aforementioned one. Moreover, if an audio signal at a specific frequency is supplied in opposite phase to, for example, the lower voice coil 3, then there is an advantage that the output sound characteristic, which depends on frequency, can also be corrected, and the speaker has a wide range of application.

Figure 10:
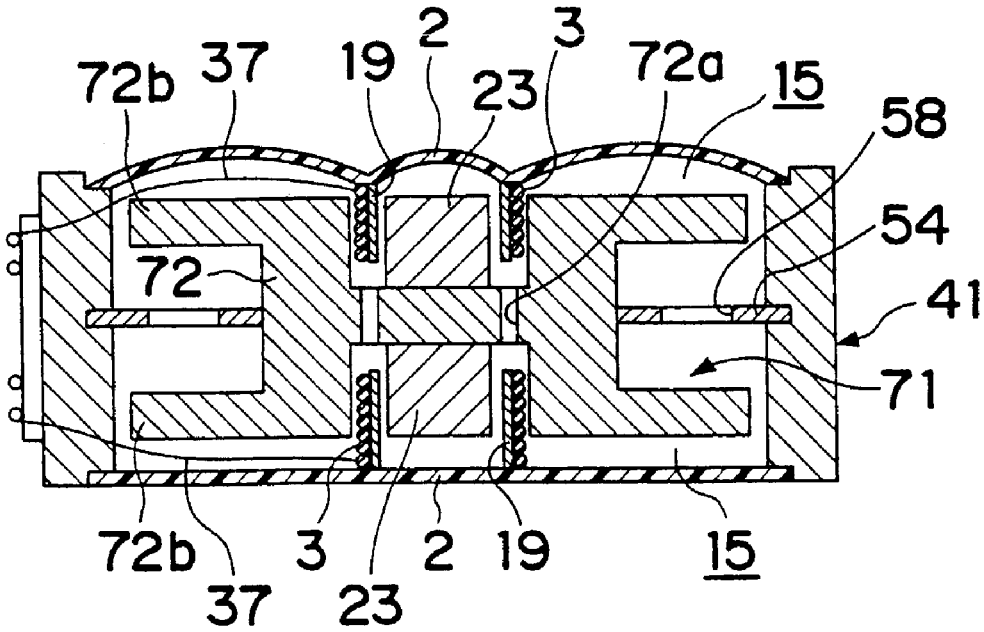
FIG. 10 is a longitudinal sectional view of a modification example of FIG. 9.

FIG. 10 shows a longitudinal sectional view of a modification example of FIG. 9. According to this speaker, the magnetic circuit section 61 of FIG. 9 is formed into a magnetic circuit section 71 that has a vertically symmetrical configuration with respect to the first elastic plate 58, and the lower diaphragm 2 is provided in the form of a flat diaphragm 2. Therefore, if the first elastic plate 54 is fixed in the position of a horizontal bottom portion that belongs to a lower plate 72 of the magnetic circuit section 71 and has a through hole 72*a*, then the magnetic circuit section 71 is supported in the position of the center of gravity. The well-balanced support of the magnetic circuit section 71 provides a synergetic effect with the vertically symmetrical arrangement of the voice coils 3 and 3 to stabilize the vibrations of the magnetic circuit section 71 by the voice coils 3 and allow a satisfactory sound to be produced. Moreover, a flange portion 72*b*, which is engaged with the casing 41 with interposition of a small gap, is also provided at the lower end of the magnetic circuit section 71. Therefore, even if the speaker suffers impact due to falling or the like, the first elastic plate 54 that supports the magnetic circuit section 51 is not excessively deformed, and the first elastic plate 54 can more reliably be prevented from being damaged. The other operation and effects are as described in connection with the embodiment of FIG. 9.

Figure 11:
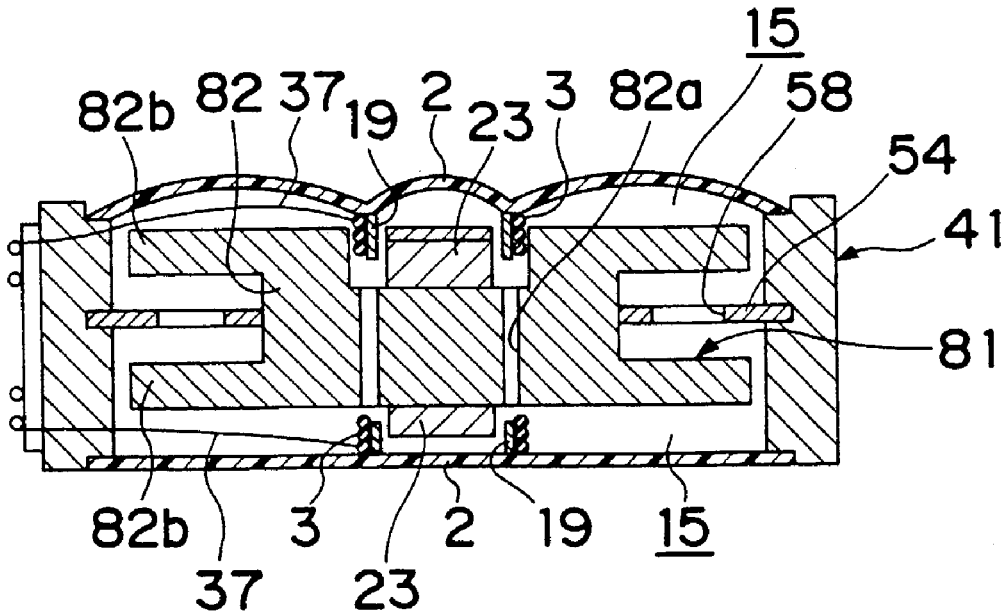
FIG. 11 is a longitudinal sectional view of a modification example of FIG. 10.

FIG. 11 is a longitudinal sectional view showing a modification example of FIG. 10. In order to achieve the downsizing of this speaker with a reduced casing length, the annular wall, which projects downward from the lower plate 72 of the magnetic circuit section 71 of FIG. 10, is eliminated, a magnetic circuit section 81 is provided with the permanent magnet 23 provided projectingly at the center of a lower flange portion 82*b*, and the lower voice coil 3 is shortened.

This speaker produces operation and effects similar to those of the embodiment of FIG. 10 except for the advantage that further downsizing can be achieved with the shortened lower voice coil 3 and the vertically asymmetrical arrangement of the magnetic circuit section 71.

It is needless to say that the portable communication equipment of the present invention includes the pager, the transceiver and the waterproof headphone of the aforementioned embodiments as well as a variety of devices such as ordinary portable telephones and portable personal computers.

INDUSTRIAL APPLICABILITY

The speaker of the present invention, which has a small size and a satisfactory output sound frequency characteristic, can suitably be used for an underwater headphone and a portable telephone.

What is claimed is:

1. A speaker comprising:

a casing;

a diaphragm for sealing an interior of the casing;

a voice coil provided projectingly on the diaphragm toward the interior of the casing;

a first elastic plate for partitioning the interior of the casing into a front chamber and a rear chamber, the front chamber being located between a first side of the first elastic plate and the diaphragm and the rear chamber being on a second side of the first elastic plate;

a magnetic circuit comprising a magnet and an engagement portion, the magnetic circuit being fixed to the first elastic plate and the engagement portion being at least partially situated within the voice coil;

the first elastic plate having a through hole for communication between the front chamber and the rear chamber whereby sound produced by vibration of the first elastic plate is accompanied either by communication of air between the front chamber and the rear chamber via the through hole or by resonance of the air in the front chamber and the rear chamber; a first connecting member comprising an elastic material for connecting the engagement portion of the magnetic circuit with the diaphragm; a second elastic plate comprising an elastic material and situated to oppose the first elastic plate; an inertial member fixed on the second elastic plate, and a second connecting member comprising an elastic material for connecting the second elastic plate with the first elastic plate and wherein one surface of the second elastic plate is exposed to outside.

2. The speaker as claimed in claim 1, wherein the first elastic plate is a disk such that the magnetic circuit section is fixed to a center hole and its periphery is fixed to an inner wall of the casing, and the through hole is provided with an identical shape in areas obtained by dividing the disk equally into a prescribed number of sectors and comprised of a first arc-shaped groove that is opened at one end of an outer periphery of the sector and approaches the center hole while extending in a circumferential direction to the other end of the sector and a second arc-shaped groove that is opened at the other end of the outer periphery of the sector and approaches the center hole while extending in the circumferential direction to the other end of a sector whose one end abuts against the other end of the sector.

3. The speaker as claimed in claim 1, wherein the engagement portion of the magnetic circuit has a through hole for communication between an inner portion in which the voice coil is inserted and an outer portion.

4. The speaker as claimed in claim 1, wherein the diaphragm, the magnetic circuit and the inertial member mainly resonate making air communication via the through hole of the first elastic plate when a frequency of an output sound of the speaker is not higher than 250 Hz, and the diaphragm, the air in the front chamber located between the first elastic plate and diaphragm and the air in the rear chamber located between the first elastic plate and the second elastic plate mainly resonate when the frequency exceeds 250 Hz.

5. The speaker as claimed in claim 1, wherein a sound is produced by the vibrations of the first elastic plate accompanied by communication of air in the front chamber and the rear chamber via the through hole of the first elastic plate when an output sound has a low frequency and by resonance of the air in the front chamber and the rear chamber when the output sound has a high frequency.

6. The speaker as claimed in claim 2, wherein the magnetic circuit has a flange portion to be engaged with the casing with interposition of a small gap at an end portion located on the diaphragm side.

7. The speaker as claimed in claim 2, wherein the magnetic circuit is fixed to the center hole of the disk in a position of the center of gravity of the magnetic circuit.

8. The speaker as claimed in claim 2, wherein the magnetic circuit has a shape of plane symmetry with respect to the disk, and a bottom portion of the casing is sealed with the diaphragm.

9. The speaker as claimed in claim 2, wherein the casing has a bottom portion sealed with the second elastic plate, defining the rear chamber between the second elastic plate and the first elastic plate.

10. The speaker as claimed in claim 1, wherein the casing and the diaphragm are made of a waterproof material.

11. The speaker as claimed in claim 1, wherein the voice coil is comprised of a first coil to which an electrical signal corresponding to a sound is inputted and a second coil to which an electrical signal corresponding to an alarm sound and vibrations for message arrival information are inputted.

12. A portable communication device, whose main body casing is provided with the speaker claimed in claim 1.

13. The portable communication device as claimed in claim 12, provided as a submersible portable communication device in which the speaker is watertightly mounted on a main body casing.

14. The speaker as claimed in claim 1, wherein the first elastic plate is a disk having a gimbal configuration, with plural peripheral portions of the first elastic plate being fixed to an inner wall of the casing, the first elastic plate having a center hole;

wherein the magnetic circuit is situated in the center hole of the first elastic plate.

15. The speaker as claimed in claim 14, wherein the first elastic plate comprises plural sectors defined by respectively plural arc-shaped grooves.

16. The speaker as claimed in claim 14, wherein the magnetic circuit has a flange portion to be engaged with the casing with interposition of a small gap at an end portion located on the diaphragm side.

17. The speaker as claimed in claim 14, wherein the magnetic circuit is fixed to the center hole of the disk in a position of the center of gravity of the magnetic circuit.

18. The speaker as claimed in claim 14, wherein the magnetic circuit has a shape of plane symmetry with respect to the disk, and a bottom portion of the casing is sealed with the diaphragm.

19. The speaker as claimed in claim 14, wherein the casing has a bottom portion sealed with the second elastic plate, defining the rear chamber between the second elastic plate and the first elastic plate.

20. The speaker as claimed in claim 1, further comprising a second elastic plate connected to the first elastic plate, wherein the first elastic plate has a number of through holes, and wherein the number of through holes, a diameter of the through holes, and a mass of the magnetic circuit are chosen to control whether the second elastic plate resonates relative to a specified frequency.

21. The speaker as claimed in claim 1, wherein the magnetic circuit is fixed to the first side of the first elastic plate and located essentially entirely on the first side of the first elastic plate in the front chamber.

* * * * *